US010364634B1

(12) United States Patent
Watson et al.

(10) Patent No.: US 10,364,634 B1
(45) **Date of Patent: *Jul. 30, 2019**

(54) HYDRAULIC JAR WITH LOW RESET FORCE

(71) Applicant: Thru Tubing Solutions, Inc., Oklahoma City, OK (US)

(72) Inventors: Brock W. Watson, Oklahoma City, OK (US); Roger L. Schultz, Ninneka, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 183 days.

This patent is subject to a terminal disclaimer.

(21) Appl. No.: 15/253,402

(22) Filed: Aug. 31, 2016

Related U.S. Application Data

(63) Continuation of application No. 14/064,353, filed on Oct. 28, 2013, now abandoned, which is a continuation of application No. 13/585,390, filed on Aug. 14, 2012, now Pat. No. 8,657,007.

(51) Int. Cl.
*E21B 17/20* (2006.01)
*E21B 31/113* (2006.01)

(52) U.S. Cl.
CPC ..... *E21B 31/1135* (2013.01); *E21B 17/20* (2013.01)

(58) Field of Classification Search
CPC .. E21B 31/107; E21B 31/113; E21B 31/1135; E21B 17/07
See application file for complete search history.

(56) References Cited

U.S. PATENT DOCUMENTS 2,614,793 A * 10/1952 Storm ..... E21B 31/107 137/860
3,005,505 A * 10/1961 Webb ..... E21B 31/113 175/297
3,562,807 A * 2/1971 Slator et al. ..... E21B 31/113 175/297
3,804,185 A * 4/1974 Mason ..... E21B 31/113 166/178
RE28,768 E * 4/1976 Mason ..... E21B 31/113 166/178
3,955,634 A * 5/1976 Slator ..... E21B 31/113 175/297
3,987,858 A * 10/1976 Slator ..... E21B 31/113 175/297

(Continued)

*Primary Examiner* — Blake E Michener
(74) *Attorney, Agent, or Firm* — Mary M. Lee

(57) ABSTRACT

A hydraulic jar for delivering impacts downhole. The jarring mechanism includes a cup-type piston that moves through a seal bore. The cup is deformable in response to fluid pressure so that it expands each time it moves through the seal bore to compensate for wear on the lip. Since only minimum interference is required between the piston and seal bore, less material may be used. This reduces the force required to reset the tool, which is particularly advantageous in horizontal wells. The seal bore may be slightly wider at the exit; the cup expands to this exit diameter, ensuring an interference fit as the cup travels back through the smaller diameter entry section. The entry end of the seal bore may include longitudinal grooves. This prevents the piston cup from rupturing by preventing a fluid seal around the lip until the most of cup is inside the seal bore.

21 Claims, 12 Drawing Sheets

(56) References Cited

U.S. PATENT DOCUMENTS

| | | | | | |
|---|---|---|---|---|---|
| 4,179,002 | A * | 12/1979 | Young | E21B 31/113 | 175/297 |
| 4,181,186 | A * | 1/1980 | Blanton | E21B 31/113 | 175/297 |
| 4,196,782 | A * | 4/1980 | Blanton | E21B 31/113 | 166/178 |
| 4,361,195 | A * | 11/1982 | Evans | E21B 31/113 | 166/178 |
| 5,007,479 | A * | 4/1991 | Pleasants | E21B 31/113 | 166/178 |
| 5,123,493 | A * | 6/1992 | Wenzel | E21B 31/113 | 166/178 |
| 5,584,353 | A * | 12/1996 | Chancey | E21B 31/113 | 166/178 |
| 5,647,446 | A * | 7/1997 | Wenzel | E21B 31/113 | 166/178 |
| 5,906,239 | A * | 5/1999 | Oettli | E21B 31/1135 | 166/178 |
| 7,347,287 | B2 * | 3/2008 | Chancey | E21B 31/1135 | 166/178 |
| 8,230,912 | B1 * | 7/2012 | Connell | E21B 31/113 | 166/178 |
| 2002/0027005 | A1 * | 3/2002 | McNeilly | E21B 31/113 | 166/301 |
| 2008/0236894 | A1 * | 10/2008 | Clausen | E21B 31/1135 | 175/57 |
| 2009/0301707 | A1 * | 12/2009 | Budney | E21B 31/1135 | 166/178 |

* cited by examiner

HYDRAULIC JAR WITH LOW RESET FORCE

FIELD OF THE INVENTION

The present invention relates generally to downhole tools and methods and, more particularly, but without limitation, to tools and methods used to deliver jarring impacts to objects downhole.

DETAILED DESCRIPTION OF THE PREFERRED EMBODIMENT(S)

Figure 1:
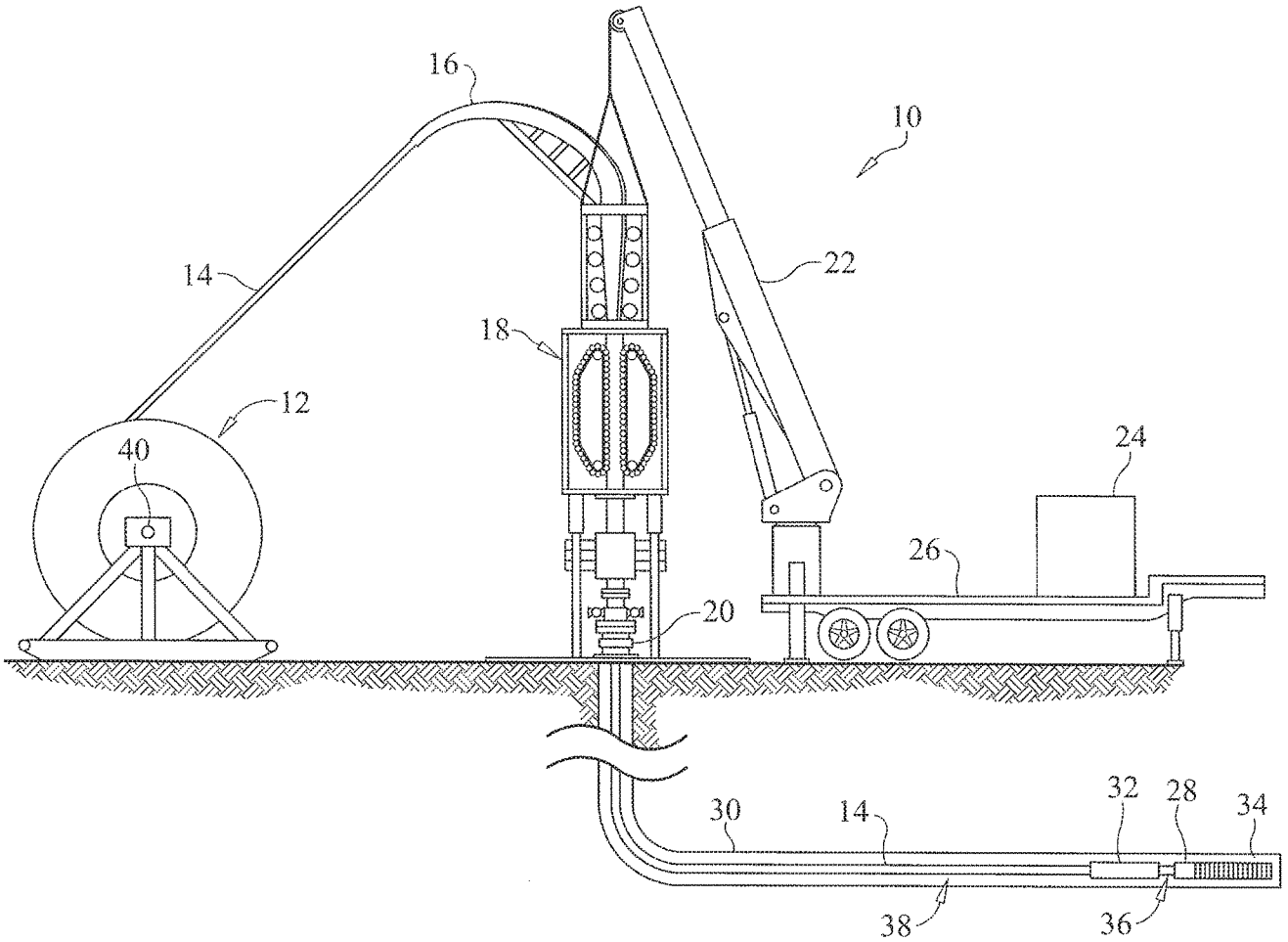
FIG. 1 is a schematic illustration of a typical coiled tubing system deploying a tool string comprising the jarring tool of the present invention.

Jarring tools are used to jar or shake loose a downhole tool or object that has become stuck or lodged in the well bore. In hydraulic or reciprocating type jars, a metering or timing section inside telescopically arranged inner and outer tubular members resists allowing the jar to extend, which provides sufficient time for the tubing string to be stretched before a hydraulic release mechanism within the jar allows rapid extension and impact within the tool. This creates a large dynamic load on the stuck tool or object. Most hydraulic jars are designed for repetitive or cyclic action to continue jarring the stuck object until it is dislodged. The cyclic firing and resetting or recocking of the jar is accomplished by pushing and pulling the tubing string.

Hydraulic jars are often run on coiled tubing. However, there are several disadvantages to using coiled tubing to run a hydraulic jar. Because of the increased frictional forces at work in a horizontal well bore, it is particularly difficult to push or "snub" coiled tubing into a horizontal well, making it difficult to cycle the jar.

The jarring tool of the present invention offers an improvement in methods and tools for jarring operations using coiled tubing. In accordance with the present invention, the piston of the jarring assembly comprises a cup that is expandable in response to fluid pressure. For example, the jarring piston may be formed of a copper alloy. Alternately, the piston may be formed of an alloy steel. The component forming the hydraulic chamber, including the seal bore, may be formed of simple steel of normal steel hardness, such as AISI 4140.

The seal bore preferably has two sections, a smaller diameter section at the entry and a larger diameter section at the outlet end. In the most preferred embodiment, the seal bore is tapered. The cup is designed to have a small interference fit with the narrow diameter end of the tapered section. The tapered section has a diameter selected to allow the piston cup to expand to the point that is becomes permanently enlarged to the larger diameter end of the tapered section. In this way, when the pressure is released, the cup's enlarged diameter will be enough to maintain the minimum required interference with the straight section of the seal bore on the next cycle. This compensates for any wear or erosion on the lip from the previous cycle.

Because the expansion of the cup as it exits the seal bore reduces the effects of wear on the cup lip from the previous cycle, the enlarged piston cup will maintain the minimum interference in the straight section of the seal bore in the next cycle. Thus, wear on the piston lip is compensated for by repeated expanding its diameter, thus removing the need to use harder, more wear-resistant material to make the cup and seal bore. This provides a relatively thin piston cup which can be pushed through the seal bore using less force, making it easier to reset the jar in every cycle.

Although the jarring tool and method of this invention is particularly useful with coiled tubing, those skilled in the art will appreciate that it can be employed with other tubular well conduits, such as jointed well tubing and drill pipe. Additionally, although this jarring tool is particularly advantageous for up jars, in which the jarring action requires snubbing the coiled tubing, down jars and bidirectional jars will be benefited by employing this inventive jarring assembly.

Turning now to the drawings in general to and to FIG. 1 in particular, there is shown therein a coiled tubing deployed jarring system. The exemplary system or "rig," designated generally by the reference number 10, includes surface equipment. The surface equipment includes a reel assembly 12 for dispensing the coiled tubing 14. An arched guide or "gooseneck" 16 guides the tubing 14 into an injector assembly 18 supported over the wellhead 20 by a crane 22. The crane 22 as well as a power pack 24 may be supported on a trailer 26 or other suitable platform, such as a skid or the like. A control cabin, as well as other components not shown in FIG. 1, may also be included.

A fishing tool 28 on the end of the tubing 14 in the wellbore 30 is used to attach a jar 32 to the stuck object 34. The combination of tools connected at the downhole end of the tubing 14 forms a tool string or bottom hole assembly ("BHA") 36. The bottom hole assembly 36 and tubing 14 combined are referred to herein as the tubing string 38. The bottom hole assembly 36 may comprise a variety of tools including but not limited to a bit, a mud motor, hydraulic disconnect, jarring tools, back pressure valves, and connector tools.

Fluid is introduced into the coiled tubing 14 through a system of pipes and couplings in the reel assembly, designated herein only schematically at 40. In accordance with conventional techniques, the jar 32 is cycled by raising and lowering the section of tubing in the injector assembly 18 repeatedly until the object 34 is dislodged.

In some instances, the jar 32 is connectable directly to the stuck object 34 in the wellbore 30. In other instances, the jar 32 is connected as one member of a bottom hole assembly comprising several tools. When the jar 32 is described as being connectable to a "stationary object downhole," it is intended to mean that the tool is connectable directly to the object or indirectly to the object through another tool in the tool string, which may have become lodged in the wellbore, or to the fishing tool 28 that is in turn attached to the stuck object 34 in the well.

The coiled tubing injection system 10 illustrated in FIG. 1 is exemplary. It is not intended to be limiting. There are several types of tubing injection systems presently available, and the present invention may be used with equal success in any of these systems. Moreover, as indicated previously, other types of well conduits may be employed instead of coiled tubing.

Figure 2:
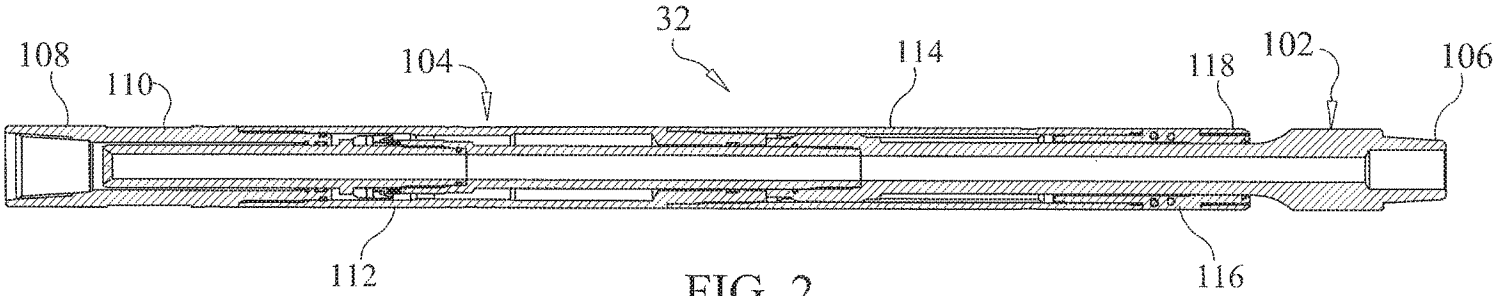
FIG. 2 is a longitudinal sectional view of a hydraulic jarring tool constructed in accordance with a first embodiment of the present invention. The jar is shown in the set or cocked position.
Figure 3:
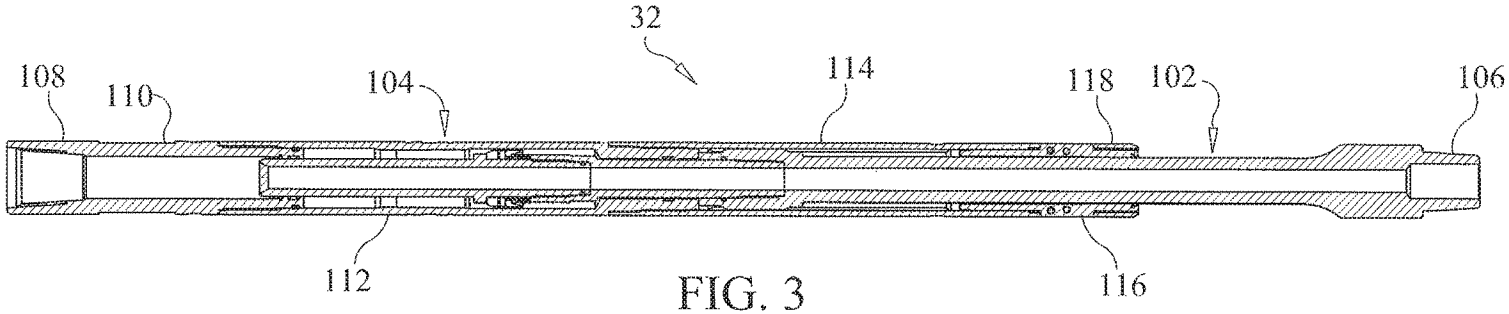
FIG. 3 is a longitudinal sectional view of the jar shown in FIG. 2 with showing the jar in the fired or discharged position.
Figure 4A:
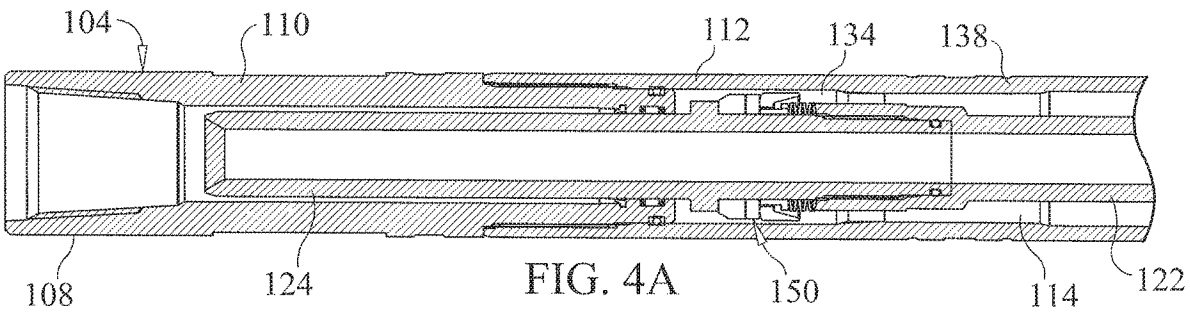
FIGS. 4A-C are enlarged sequential sectional views of the tool of FIG. 2 showing the jar in the set or cocked position.
Figure 4B:
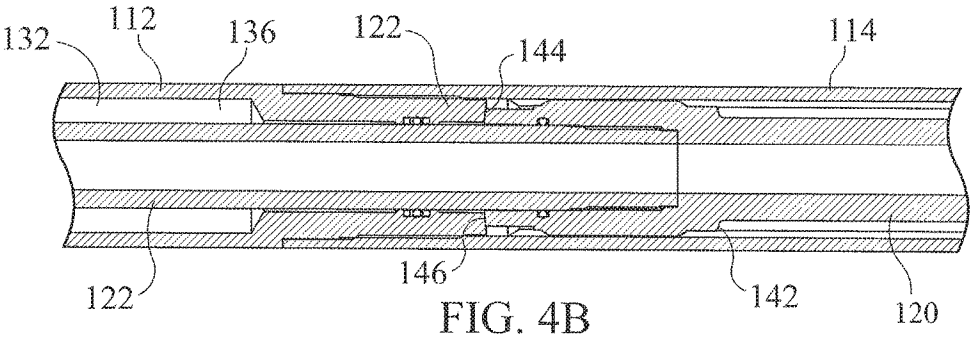
Figure 4C:
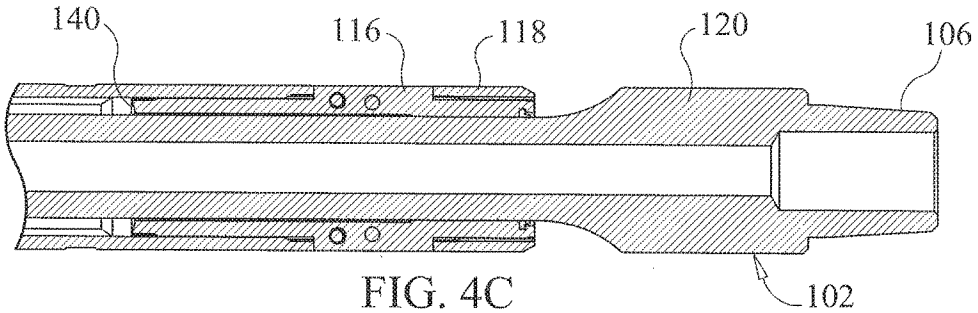
Figure 5A:
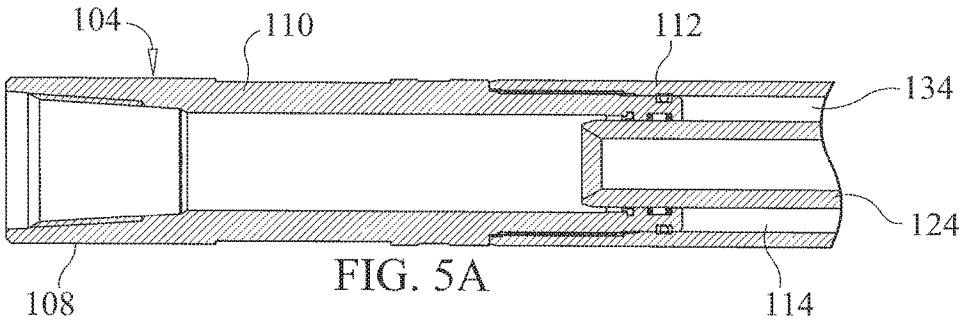
FIGS. 5A-5C are enlarged sequential sectional views of the tool of FIG. 3 showing the jar in the fired or discharged position
Figure 5B:
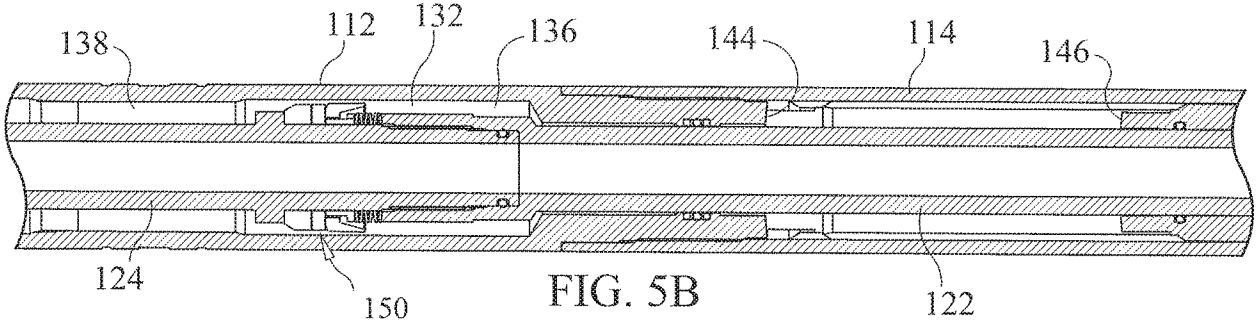
Figure 5C:
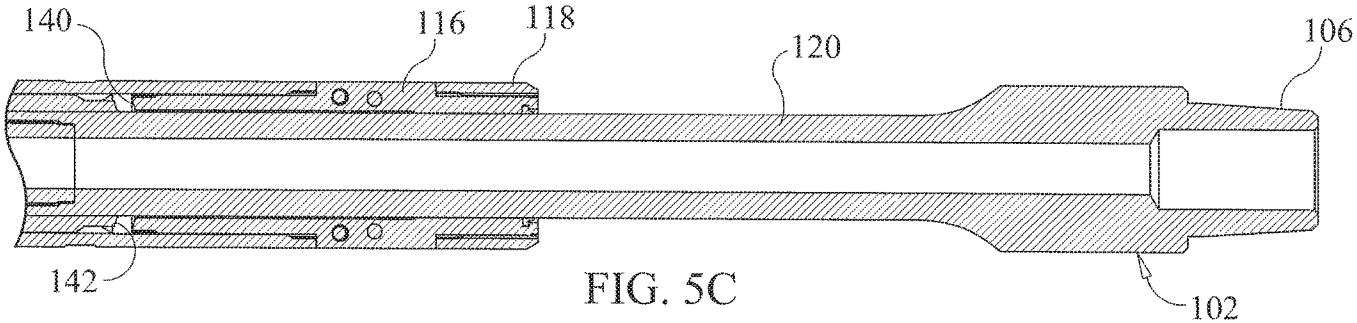

Turning now to FIGS. 2 and 3, the jarring tool 32, made in accordance with a first preferred embodiment of the present invention, will be described in detail. FIG. 2 shows the jar 32 in the cocked or set position, and FIG. 3 shows the jar in the fired or discharged position. The jar 32 comprises two telescopically engaged tubular assemblies, including an inner tubular assembly or mandrel 102 and an outer tubular assembly or housing 104. The housing 104 and the mandrel 102 have telescopically engaged portions that are axially movable relative to each other to fire and reset the jarring tool 32.

Either the mandrel 102 or the housing 104 is attachable to the well conduit 14, and the other is attachable to the fixed object 34 in the wellbore 30. In the particular embodiment shown, the downhole end 106 of the mandrel 102 is attachable to the stuck or stationary object 34, and the uphole end 108 of the housing 104 is attached to the tubing 14. In this way, the housing 104 is moved up or down relative to the mandrel 102. However, it will be appreciated that this arrangement may be reversed, that is, the housing may be attachable to the downhole object (or other tool) and the mandrel attachable to the well conduit.

As used herein, the terms "up," "upward," "upper," and "uphole" and similar terms refer only generally to the end of the drill string nearest the surface. Similarly, "down," "downward," "lower," and "downhole" refer only generally to the end of the drill string furthest from the well head. These terms are not limited to strictly vertical dimensions. Indeed, many applications for the tool of the present invention include non-vertical well applications.

Throughout this specification, the mandrel 102 and housing 104 as well as the jarring assembly components are described as moving "relative" to one another. This is intended to mean that either component may be stationary while the other is moved. Similarly, where a component is referred to as moving "relatively" downwardly or upwardly, it includes that component moving downwardly as well as the other, cooperative component moving upwardly.

In the preferred embodiment, the housing 104 comprises a top sub 110 which is provided with a internally threaded end or box joint forming the upper end 108 for attachment to the coiled tubing 14 or to another tool in the tool string 36. An upper housing 112 is connected to the downhole end of the top sub 110, and a lower housing 114 is connected to the downhole end of the upper housing. A wiper seal sub 116 connects to the downhole end of the lower housing 114, and a collar or split sub 118 connects to the downhole end of the wiper seal sub, forming the lower end of the housing 104. While this is a preferred assembly for the housing, the components of the housing may vary in number and configuration.

Referring still to FIG. 4A-4C and FIGS. 5A-5C, the mandrel 102 preferably comprises a lower mandrel 120 with an externally threaded downhole end forming the lower end 106 of the tool. A center mandrel 122 is connected to the uphole end of the lower mandrel 120, and an upper mandrel 124 is connected to the uphole end of the center mandrel.

The preferred tool 32 includes a jarring assembly designated generally at 130. The telescopically engaged portions of the housing 104 and the mandrel 102 are configured to form a hydraulic jarring chamber 132 therebetween. The hydraulic chamber 132 includes an upper or low pressure chamber 134, a lower high pressure chamber 136, and a narrow diameter seal bore 138 therebetween. It will be understood that in a down jar version of this tool, the lower chamber will be the high pressure chamber and the upper chamber will be the low pressure chamber.

The jarring impact is created when an impact surface on the housing 104, such as the hammer surface 140 impacts an impact surface on the mandrel 102, such as the anvil surface 142. When the tool is reset or cocked, an impact surface 144 on the housing 104 abuts an impact surface 146 on the mandrel 102, to limit the travel of the housing when being reset. The shape and location of these impact surfaces may vary.

Figure 6:
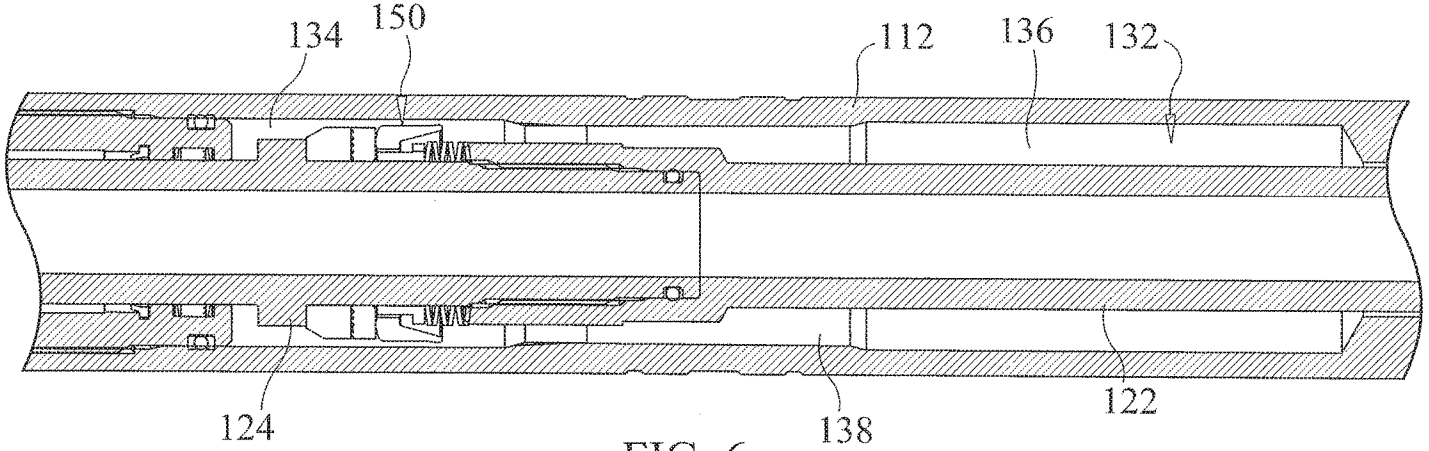
FIG. 6 is a further enlarged sectional view of the hydraulic jarring assembly of the tool of FIG. 2. The piston is in the set or cocked position in the upper chamber.
Figure 7:
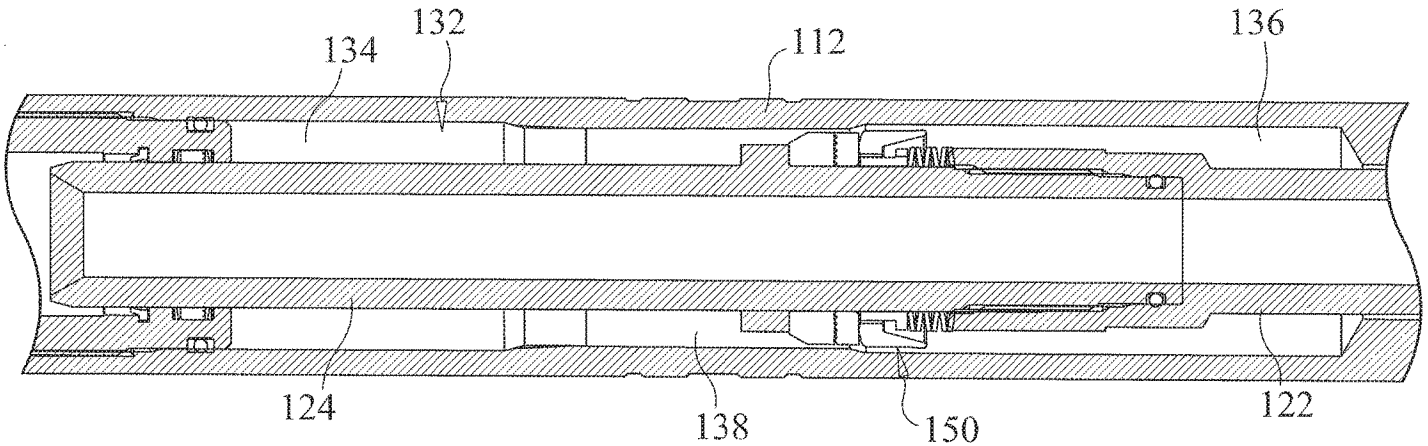
FIG. 7 is a further enlarged sectional view of the hydraulic jarring assembly of the tool of FIG. 3. The piston is in the fired or discharged position in the lower chamber.

A piston assembly 150 is supported on the upper mandrel 124 for movement inside the hydraulic jarring chamber 132. As shown in FIG. 6, in the cocked or set position, the piston assembly 150 is positioned in the upper or low pressure chamber 134. As the housing 104 is pulled up, the piston assembly 150 is squeezed through the seal bore 138 and into the lower or high pressure chamber 134, as shown in FIG. 7. As explained in more detail below, the jarring impact results from a sudden pressure drop when the piston assembly 150 exits the seal bore 138.

Figure 8:
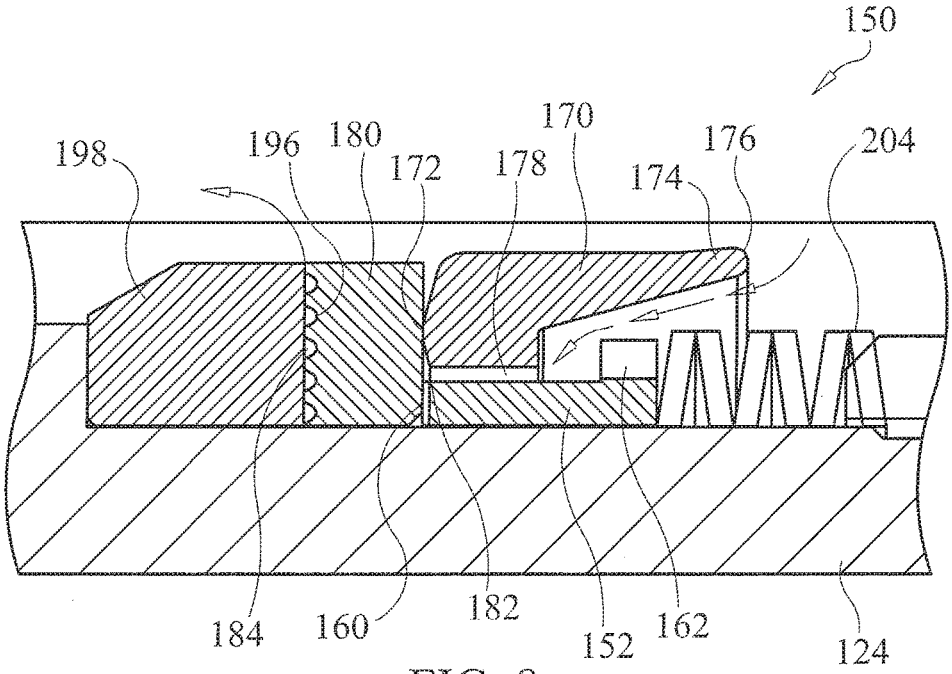
FIG. 8 is an enlarged sectional view of the mandrel showing the piston assembly in the position it assumes as it moves through the seal bore towards the lower chamber to initiate a jarring impact.
Figure 9:
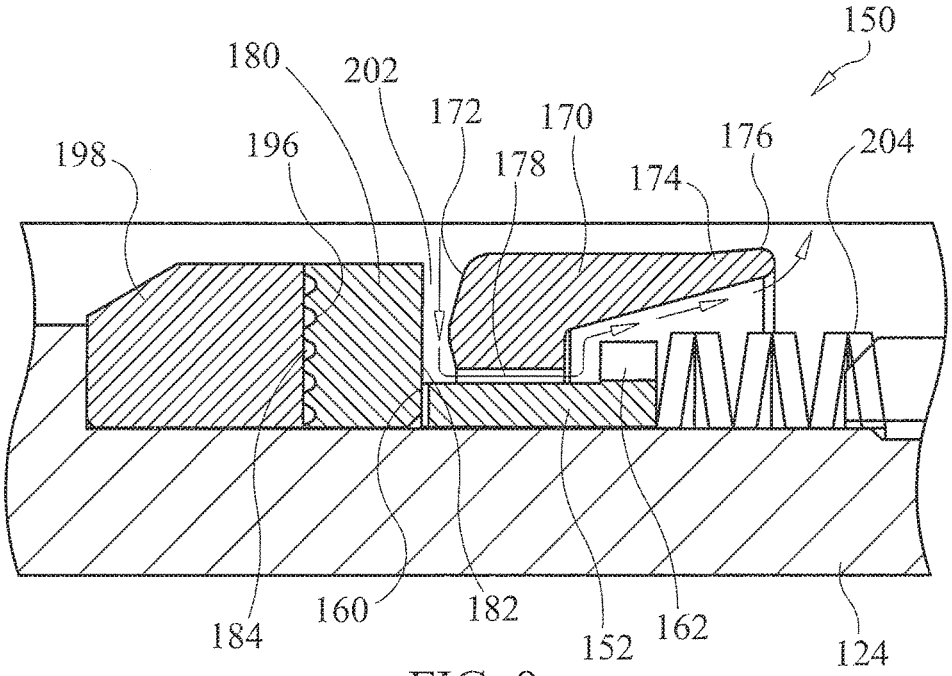
FIG. 9 is an enlarged sectional view of the mandrel showing the piston assembly in the position it assumes as it moves through the seal bore towards the upper chamber to reset the tool.
Figure 10:
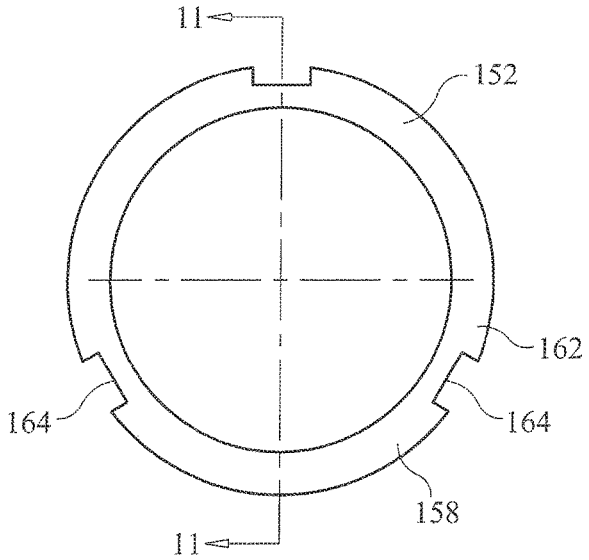
FIG. 10 is an end view of the cup end of the jar piston sleeve.
Figure 11:
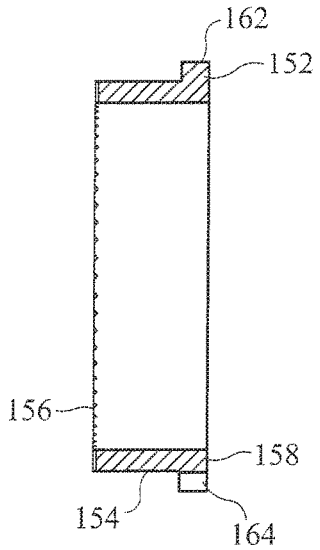
FIG. 11 is a sectional view taken along line 11-11 of FIG. 10 through the jar piston sleeve.
Figure 12:
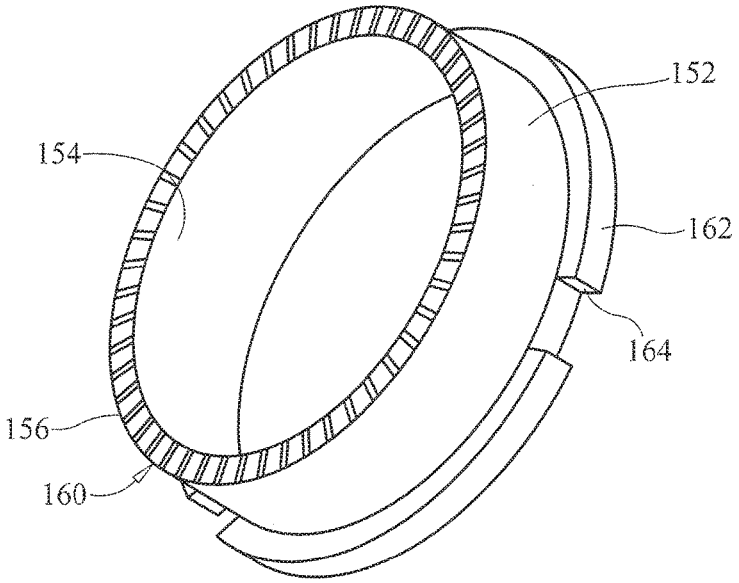
FIG. 12 is a perspective view of the base end of the jar piston sleeve.
Figure 13:
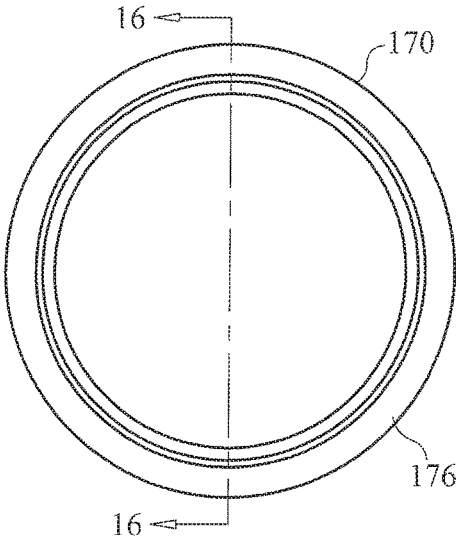
FIG. 13 is an elevational view of the base end of the jar piston.
Figure 14:
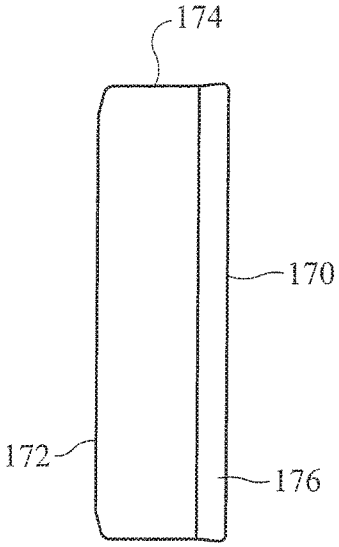
FIG. 14 is a side elevational view of the jar piston.
Figure 15:
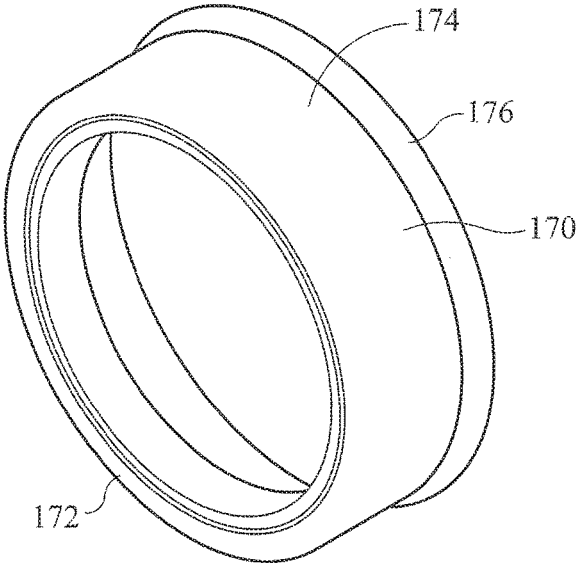
FIG. 15 is a perspective view of the base end of the jar piston.
Figure 16:
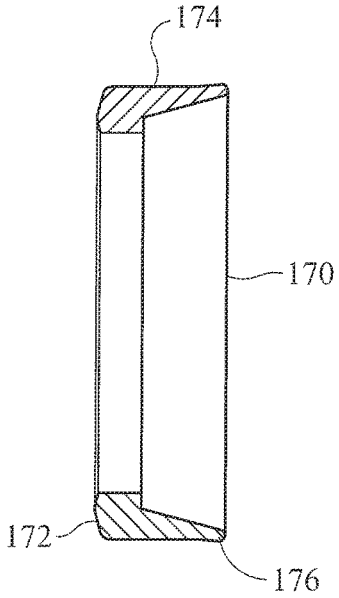
FIG. 16 is a sectional view taken along line 16-16 of FIG. 13.
Figure 17:
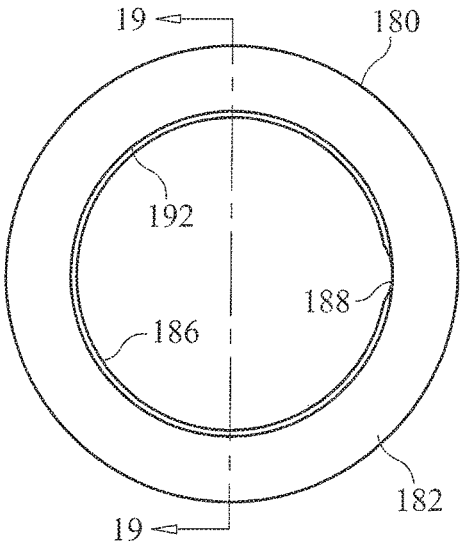
FIG. 17 is an elevational view of the piston face of the timing washer.
Figure 18:
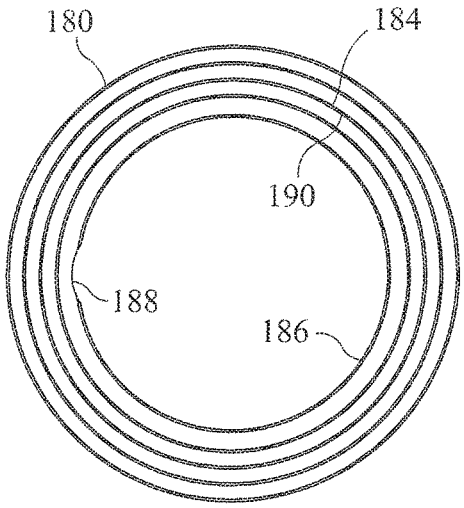
FIG. 18 is an elevational view of the timing face of the timing washer.
Figure 19:
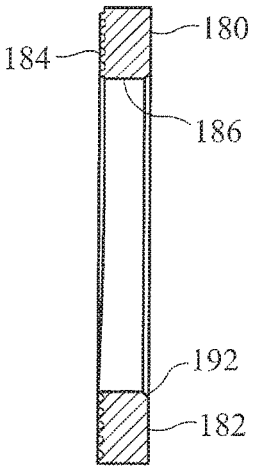
FIG. 19 is a sectional view taken along line 19-19 of FIG. 17.
Figure 20:
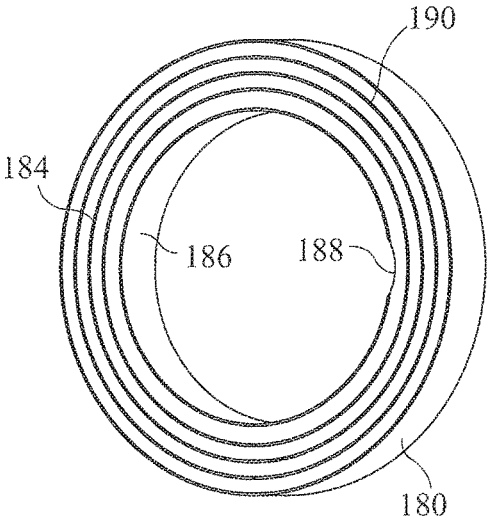
FIG. 20 is a perspective view of the timing face of the timing washer.

Turning now to FIGS. 8 and 9, the structure and operation of the piston assembly 150 will be explained. The preferred piston assembly 150 comprises a piston sleeve 152 supported on the outer diameter of the upper mandrel 124. The piston sleeve 152, shown in more detail in FIGS. 10-12, comprises a sleeve body 154 with a first or base end 156 and a flanged second or cup end 158. The base end 156 is provided with radial grooves 160, and a flange 162 extends from the second end 158. The flange 162 has notches 164.

A cup-type piston 170 is slidably supported coaxially around the piston sleeve 152. The piston 170, shown in detail in FIGS. 13-16, has a base end 172, which preferably is curved or otherwise profiled so as to be nonplanar for a reason which will become apparent. A cup 174 extends from the base 172 and terminates in a lip 176. The inner diameter of the base 172 of the piston 170 is slightly larger than the outer diameter of the sleeve 152 to provide a flow channel 178 therebetween.

The piston assembly 150 further comprises a timing washer 180, shown in detail in FIGS. 17-20. The timing washer 180 has an annular piston face 182 on one end and a metering face 184 on the other end. The inner diameter 186 of the timing washer 180 has a lengthwise groove 188 that is continuous with a spiral bleed channel 190 formed on the metering face 184. The edge 192 between the inner diameter 186 and the piston face 182 is beveled.

As best seen in FIGS. 8 and 9, the timing washer 180 is supported on the upper mandrel 124 so that the piston face 182 opposes and is adjacent to the base end 172 of the piston 170 and the grooved base end 156 of the piston sleeve 152. The metering face 184 of the timing washer 180 abuts the annular face 196 of a collar 198, which is captured on an annular shoulder 200 formed near the lower end of the upper mandrel 124.

One or more springs 204 are supported between the flanged end 162 of the piston sleeve 152 and uppermost end 206 of the center mandrel 122. These springs are included to accommodate slight variances in tolerances resulting from manufacturing. Thus, the springs should be strong enough to resist any movement in the piston sleeve 152 during operation of the tool.

As the housing 104 is pulled up on the mandrel 102 (towards the left in FIG. 8), and the piston assembly 150 is squeezed downwardly relative to the seal bore 138 (FIG. 6) with the open end of the piston cup 174 leading. The fluid pressure causes the piston lip 176 to seal against the seal bore 138, and the base 172 of the piston 170 is urged into engagement with the piston face 182 of the timing washer 180. This forces the hydraulic fluid along a restricted flow path indicated by the arrows in FIG. 8. More specifically, the fluid enters the piston cup 174 and passes through the flow channel 178 between the inner diameter of the piston base 172 and the outer diameter of the sleeve body 154. The fluid then flows through the flow channel formed by the grooves 160 on the grooved end 156 of the piston sleeve, through the lengthwise groove 188 on the inner diameter 186 of the timing washer 180, and then enters the spiral bleed channel 190 on the metering face 184.

When the fluid reaches the end of the spiral channel 190 it exits the piston assembly 150 around the outer diameter of the timing washer 180 and flows up into the upper or low pressure chamber 134 (FIG. 6). This restricted flow path creates pressure that is suddenly released when the piston assembly 150 exits the seal bore 138, generating the sudden jarring impact.

The piston assembly 150 also provides an unrestricted flow path for passage of the hydraulic fluid through the piston assembly when it passes through the seal bore 138 (FIG. 7) is the opposite direction to reset the tool. This unrestricted flow path is illustrated in FIG. 9. As the housing 104 is pushed down on the mandrel 102 (towards the right in FIG. 9) to reset the tool, the piston 170 is urged toward the springs 204 creating a space 202 between the base end 172 of the piston and the piston face 182 of the timing washer 180. This allows the hydraulic fluid to pass from the flow channel 178 between the piston 170 and sleeve 152 out into seal bore through the space 202, bypassing the flow channel formed by the grooves 160 in the end of the sleeve and the spiral bleed channel 190.

While a preferred timing or metering mechanism has been shown and described herein, it will be appreciated that the present invention is not so limited. Other metering structures, such as annular flow channels, orifices, tortuous paths of different configuration, may be employed.

Directing attention now to FIG. 21, the preferred configuration for the seal bore 138 will be explained. The seal bore 138 is formed by a narrow or restricted diameter portion in the upper housing 124. The seal bore 138 has an entrance end 210 and an exit end 212. These terms are intended to indicate the direction of the piston assembly 150 as it is passes through the seal bore 138 during a jarring stroke, where the open cup end of the piston 170 is the leading end of the assembly.

In the preferred seal bore 138, the bore comprises a smaller diameter section and a larger diameter section. Most preferably, these different diameter sections take the form of a straight section at the entrance end 210 of the bore 138 and a tapered section extending from the straight section to the exit end 212 of the bore. The straight section, designated by the arrow 218, is relatively short compared to the tapered section, designated by the arrow 220. While this straight section is advantageous for manufacturing and assembly, it is not essential to the function of the seal bore.

The straight section 218 has a constant diameter along its length designated as "$d_1$." The tapered section 220 gradually increases in diameter from the dimension $d_1$ to a slightly larger diameter at the exit end designated as "$d_2$." By way of example only, if the piston 170 is made from 110 KSI copper allow and is about 0.060 inch thick, and if the straight section is 2.25 inches in diameter ($d_1$) and 0.63 in length, the tapered section 220 may gradually increase in diameter to 2.272 inches in diameter ($d_1$) at the exit end 212 having a length of 2.75 inches, that is, a taper of 0.004 per inch.

The purpose of the tapered section with its slightly increasing diameter is to allow the diameter of the piston cup 174 to permanently expand slightly in response to fluid pressure. As indicated, the piston 170 is designed to permanently expand slightly in response to fluid pressure. More particularly, the piston is designed to permanently expand at a pressure that is lower the operating pressure of the hydraulic fluid. By way of example, the piston may be formed of a metal alloy, such as a copper alloy, that is slightly resilient so that the fluid pressure will expand the cup to the largest diameter of the seal bore. While the metallic cup may not retain the fully expanded diameter, neither will it resume its smallest original diameter; instead, the cup will maintain a slightly enlarged diameter that is larger than the smaller diameter section of the seal bore. Thus, the present invention includes the use of resilient and non-resilient cup materials that are capable of some permanent expansion.

The tapered section 220 is selected to achieve the desired permanent reformed diameter of the piston cup, which is a function of the diameter of the straight section 218 of the seal bore 138. This is because the purpose of the expansion is to maintain a lip diameter that will provide a minimum interference fit in the straight section of the bore. Thus, the exit diameter is calculated according to the following formula:

$$d_{exit} = d_{small} \cdot \left(1 + \frac{\sigma_{y_piston}}{E_{piston}}\right)$$

Figure 21:
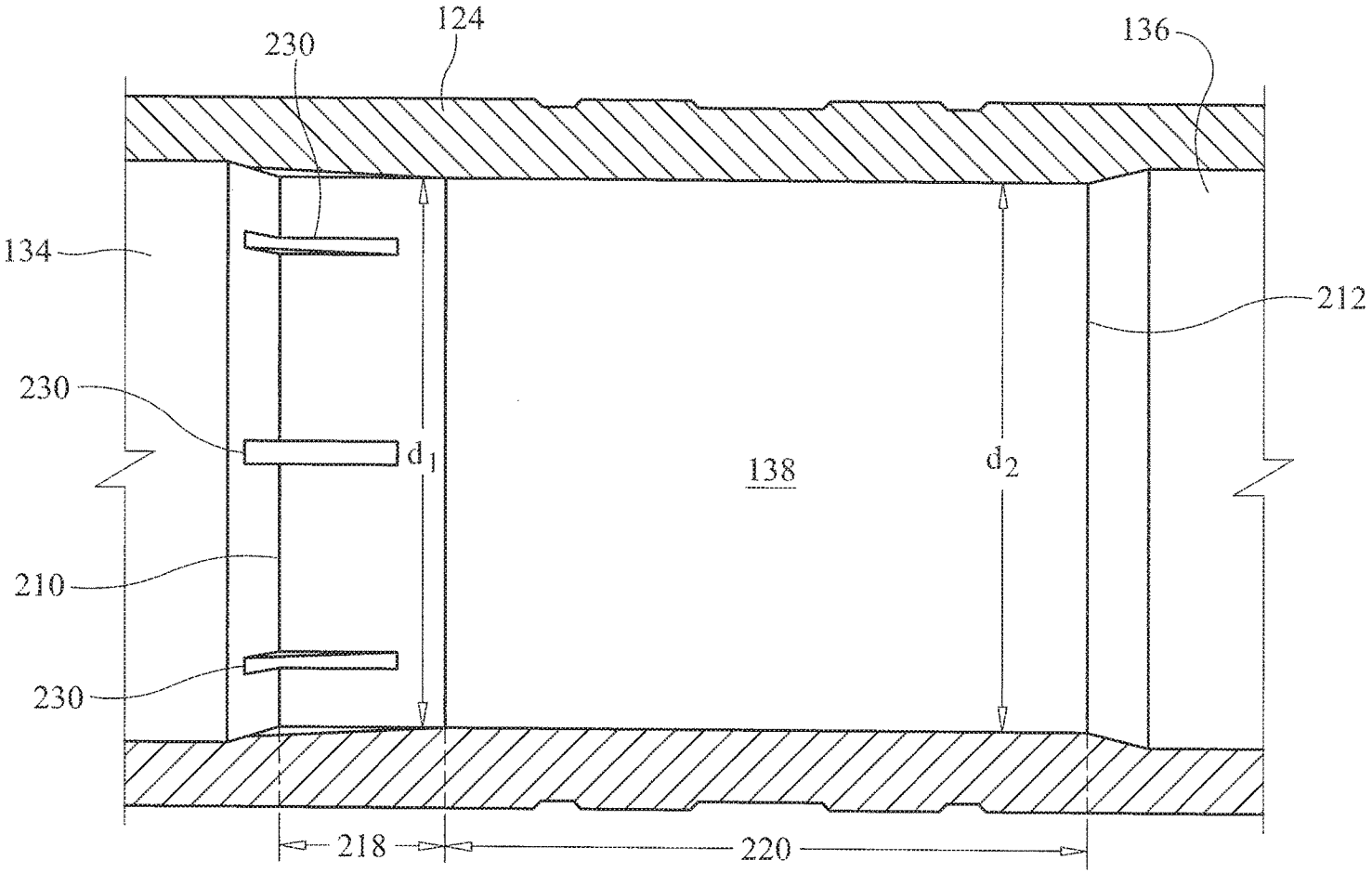
FIG. 21 is an enlarged fragmented section view of the upper housing showing the seal bore detail.

With continuing reference to FIG. 21, another desirable feature of the seal bore 138 will be described. As indicated, in the preferred practice of this invention, the piston 170 is deformable in response to the pressure of the hydraulic fluid. If the burst pressure of the piston cup 174 is low enough, there is a danger that the cup may rupture as it enters the seal bore 138.

Rupture of the cup 174 may be prevented by providing bypass recesses at the entrance end 210 to allow the hydraulic fluid to flow around the lip of the cup until the a substantial portion of the cup is inside the bore. For example, in the preferred embodiment, a plurality of longitudinal grooves 230 is provided around the entrance 210 to the bore 138 and extending a distance into the straight section 218. As the piston 170 moves into the seal bore 138 and the lip engages the wall of the bore, fluid can still pass through the grooves 230 around the lip. This prevents the full pressure of the operating fluid from acting on the cup until the cup is substantially inside the bore. How far into the seal bore the cup needs to advance to prevent rupture will vary with the pressure and the cup material. Thus, as used herein, "substantially" means that the cup has advanced far enough into the seal bore so that rupture of the cup is prevented.

Having described the structure of the tool 32, its use and operation now will be explained. Referring again to FIG. 1, the tubing string 38 is run downhole and latched onto the stuck object 34 preferably using the fishing tool 28. The tubing string 14 is slacked off to ensure that the jar 32 is in the fully telescoped or cocked position, as shown in FIGS. 2 & 4A-4C. In this position, the piston assembly 150 is in the upper or low pressure chamber 134, as shown in FIG. 6. To initiate a jarring stroke, the operator pulls upwardly on the tubing string 14 at the surface thereby exerting an upward pull on the attached jar housing 104, that is, the housing is pulled to the left in FIGS. 6 and 7. As the mandrel 102 is fixed to the stuck object, this pulling action causes the piston assembly 150 to move downwardly through the seal bore 138.

As the piston assembly 150 moves through the seal bore 138, fluid pressure below the piston assembly increases rapidly until the piston assembly enters the lower or high pressure chamber 136. At this point, there is a sudden release of the pressure, causing the housing to complete its travel to the fully extended or fired position (FIG. 7) and resulting in a jarring impact when the hammer surface 140 on the housing 104 impacts the anvil surface 142 of the mandrel 102.

To reset the tool 32, the tubing string 14 is snubbed downwardly, which forces the housing 104 to move downwardly on the mandrel 102, that is, to the right as seen in FIGS. 6 and 7. This causes the piston assembly 150 to move upwardly (to the left in FIG. 7) through the seal bore 138. Frictional drag on the piston 170 separates it from the timing washer 180 opening the space 202 (FIG. 9), thereby allowing the hydraulic fluid to pass through the unrestricted flow path (FIG. 9). When the impact surface 144 on the housing 104 abuts the impact surface 146 on the mandrel 102, the tool 32 is reset and ready for another jarring stroke. This process is repeated as often as necessary until the stuck object is dislodged.

Now it will be appreciated that as the piston cup 174 moves up and down through the seal bore 138 repeatedly, the lip 176 will be worn away. However, due to the expandable nature of the cup 174 and the increasing diameter of the seal bore 138, the cup is also repeatedly being plastically expanded to compensate for this wear.

Figure 22:
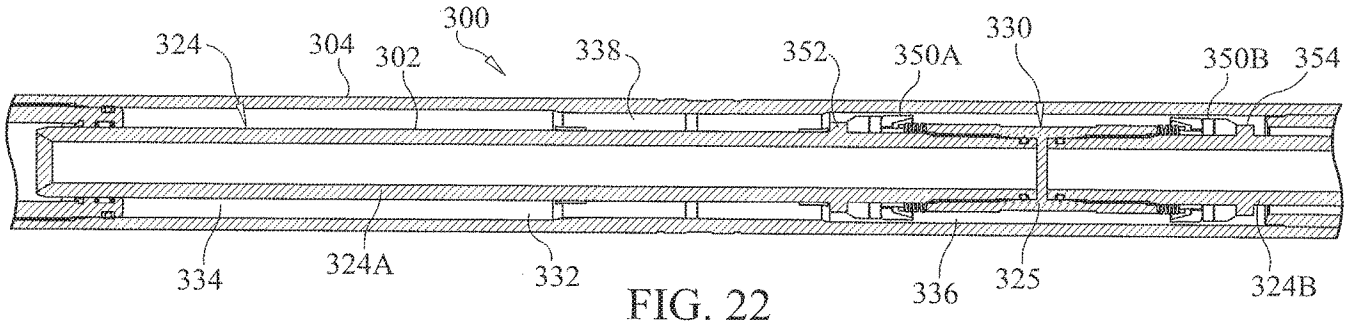
FIG. 22 is a fragmented sectional view of the jarring assembly portion of a tool constructed in accordance with a third preferred embodiment of the invention. The jarring assembly of this jar includes two piston assemblies to provide bidirectional jarring. This figure shows the jar assembly in the set or cocked position for a down jar and the fired or discharged position of an up jar.
Figure 23:
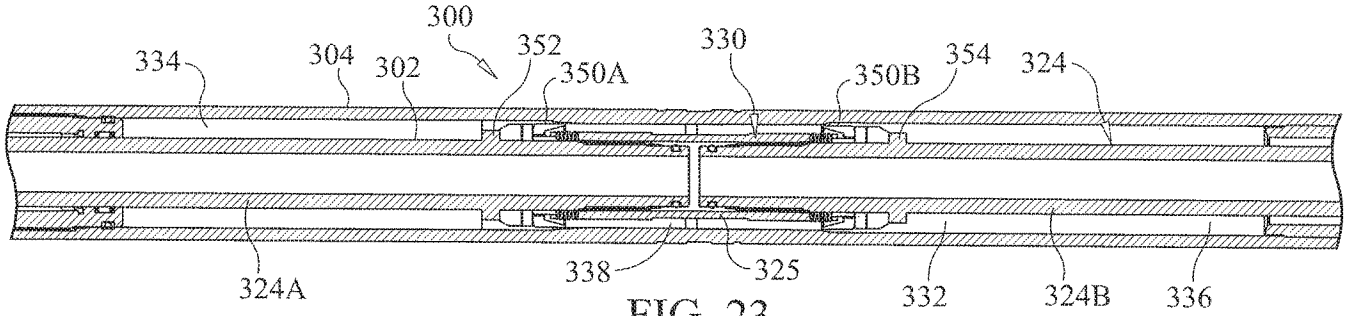
FIG. 23 is a fragmented section view of the jarring assembly of FIG. 22 with the jar pistons in the neutral position with the piston coupling positioned midway in the seal bore.
Figure 24:
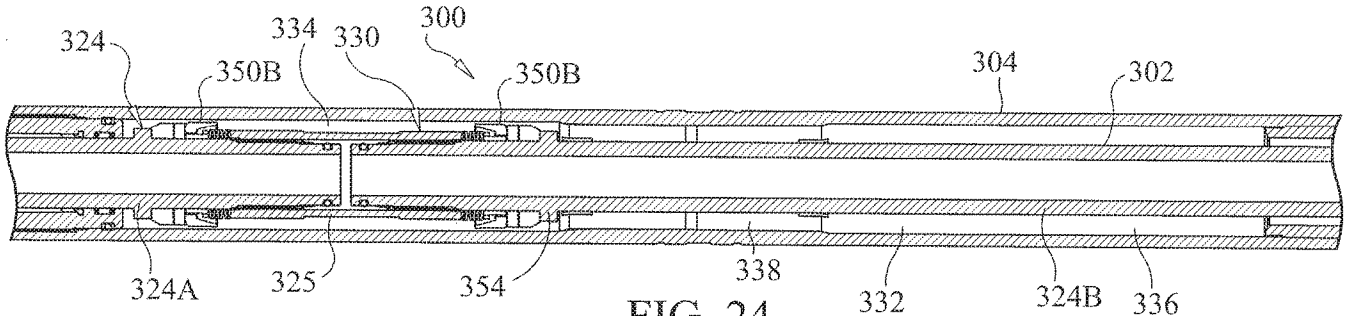
FIG. 24 is a fragmented sectional view of the jarring assembly of FIG. 22. The jarring assembly is shown in the set or cocked position for an up jar and the fired or discharged position of a down jar.

Turning now to FIGS. 22-24, another preferred embodiment of the jarring tool of the present invention will be described. In this embodiment, designated generally at 300, the tool is constructed similarly to the tool 32 of the previously described embodiment having a mandrel 302 telescopically received inside a housing 304. FIGS. 22-24 show only the section of the tool with the jarring assembly. The rest of the tool may be similar to that shown in the previous embodiment.

This embodiment includes a bidirectional jarring assembly designated generally at 330. The bidirectional jarring assembly includes a pair of piston assemblies 350A and 350B positioned in a hydraulic chamber 332. The hydraulic chamber 332 includes an upper chamber 334, a lower chamber 336, and a narrow diameter seal bore 338 therebetween. The seal bore 338 of this embodiment is adapted for two-way operation, as explained more fully below. The upper and lower hydraulic chambers 334 and 336 function alternately as high and low pressure chambers, depending on the jar direction.

Each of the piston assemblies 350A and 350B is similar to the piston assembly 150 of the jar 32 (FIGS. 2-21). The two piston assemblies 350A and 350B are oppositely oriented to each other in the tool. The piston assembly 350A is arranged similarly to the piston assembly 150 for producing an upward jar, while the piston assembly 350B is oppositely disposed to create a downward jar. The upper mandrel 324 comprises an upper section 324*a* and a lower section 324*b* joined by a mandrel coupling 325. The piston assembly 350A is captured on the upper section 324*a* of the upper mandrel 324 between the shoulder 352 and the upper end of the coupling 325, and the piston assembly 350B is captured between the lower end of the coupling and the shoulder 354 on the lower section 324*b* of the upper mandrel.

The seal bore 338 will now be described with reference to FIG. 25. The seal bore 338 comprises an up jar section 360 and a down jar section 362 and a center section 364 in between. The upper end 366 serves as the entry end for the upper piston assembly 350A, and the lower end 368 serves as the entry end for the lower piston 350B. The upper and lower ends 366 and 368 both are provided with grooves 370 and 372, respectively, for the purpose previously described. The up jar section 360 has a tapered diameter gradually increasing from the diameter $d_1$ to the slightly larger diameter $d_2$. The down jar section 362 has a tapered diameter gradually increasing from the diameter $d_1$ to the slightly larger diameter $d_2$. The center section 364 is straight or cylindrical.

Now it will be apparent that the up jar piston assembly 350A will function similarly to the previously described embodiment. The piston assembly 350A will produce an up jar when it passes downwardly through the up seal bore 338 from the position shown in FIG. 24, through the mid-stroke position shown in FIG. 23, and then to the down stroke or discharged position shown in FIG. 22, in same manner as the piston assembly 150 of the up jar 32 previously described. Now it will be apparent that the discharge position of the up jar action is the set or cocked position for a subsequent down jar. A down jar is produced when the down jar piston assembly 350B passes upwardly through the seal bore 338 from the position shown in FIG. 22, through the mid-stroke position shown in FIG. 23, and then to the upstroke or discharged position shown in FIG. 22. In this way, the jar 300 can produce alternating bidirectional jarring forces.

Figure 25:
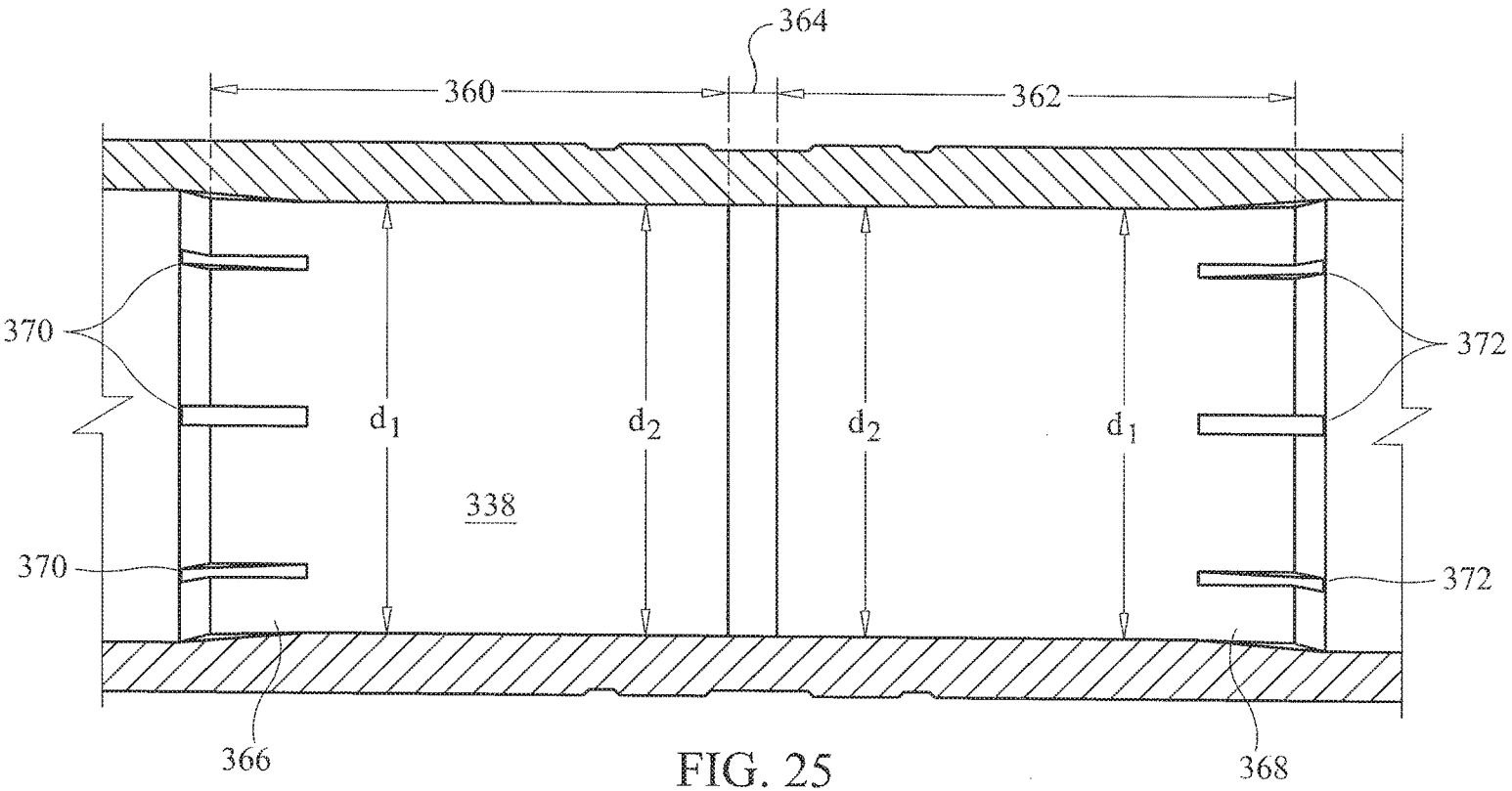
FIG. 25 is an enlarged fragmented section view of the upper housing of the tool shown in FIG. 22 showing the seal bore detail.

Referring still to FIG. 25, the plastic expansion of the cup pistons in the piston assemblies occurs in a similar fashion. The piston cup of the jar assembly 350A creates a seal with the seal bore as the cup enters the end 366. The cup expands as it moves through the tapered section 360 (to the right in FIG. 25) during an up jar, as previously described. The enlarged cup maintains the seal as it passes through the reversely tapered section 362 and exits the seal bore 338 to create an up jar.

The piston cup of the jar assembly 350B creates a seal with the seal bore as the cup enters the end 368. The cup expands as it moves through the tapered section 362 (to the left in FIG. 25) during a down jar, as previously described. The enlarged cup maintains the seal as it passes through the reversely tapered section 360 and exits the seal bore 338 to create a down jar.

Having described the structure of the tool 300, its use and operation will now be explained. Referring again to FIGS. 22-24, the tubing string 38 is run downhole and latched onto the stuck object 34 preferably using the fishing tool 28. The tubing 14 is slacked off to ensure that the jar 300 is in the fully telescoped position, which means it is set or cocked for an up jar, as shown in FIG. 24. In this position, the piston assemblies 350A and 350B both are in the upper chamber 334.

To initiate an up jar stroke, the operator pulls upwardly on the tubing string 14 at the surface thereby exerting an upward pull on the attached jar housing 304. As the mandrel 302 is fixed to the stuck object, this pulling action causes the piston assemblies 350A and 350B to move downwardly through the seal bore 338 (to the right in FIGS. 22-24).

As previously described, as the up jar piston assembly 350A is forced downward (to the right) through the seal bore 338, fluid is forced through its restricted flow path of the up jar to create the sudden pressure release as it exits the seal bore. During the same stroke, the down jar piston assembly 350B moves "backwards" through the seal bore 338, allowing the fluid to pass through its unrestricted flow path.

Next, to initial a reverse or down jar, the tubing 14 is snubbed downwardly, which forces the housing 304 to move downwardly on the mandrel 302 from the position shown in FIG. 22 to the mid-stroke position shown in FIG. 23, that is to the left in FIGS. 22-24. As the down jar piston assembly 350B moves upwardly (to the left) through the seal bore 338, fluid through the down jar piston assembly is forced through its restricted flow path to create a down jar impact when the down jar piston assembly exits the upper end 366 of the seal bore 338. During this stroke, the up jar piston assembly 350A is passive, that is, it is moving backwards and the hydraulic fluid is flowing through its unrestricted flow path. A downwardly directed impact is created as the down jar piston assembly 350B enters the upper chamber 334.

This bidirectional embodiment can be operated to provide repeated jars in either an up or down direction, or alternately may be operated to provide jarring impacts in alternating directions. To fire the jar repeatedly in one direction only, the jar assembly is reset by returning the tool to the neutral or centered position shown in FIG. 23, rather than to the fully extended or retracted positions shown in FIGS. 22 and 24. From the neutral position, the jar can be fired in either direction.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts, within the principles of the invention to the full extent indicated by the broad meaning of the terms. The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. A hydraulic jarring tool for use with a well conduit in an oil or gas well, the tool comprising:

a housing;

a mandrel;

wherein one of the mandrel and the housing is attachable to the well conduit and the other of the mandrel and the housing is attachable to a fixed object in the well;

wherein the housing and the mandrel have telescopically engaged portions that are axially movable relative to each other to fire and reset the tool;

wherein the telescopically engaged portions of the housing and the mandrel are configured to form a hydraulic chamber therebetween, the hydraulic chamber including a low pressure chamber, a high pressure chamber, and a narrow diameter seal bore therebetween;

wherein the seal bore has a smaller diameter section and a larger diameter section between the smaller diameter section and the high pressure chamber;

an impact surface formed on each of the housing and the mandrel;

a piston supported in the hydraulic chamber for relative movement between the high and low pressure chambers through the seal bore, wherein the piston comprises a cup with an open end terminating in a lip, the open end of the cup facing the high pressure chamber, the cup being deformable in response to fluid pressure, so that as the piston moves through the seal bore towards the high pressure chamber, the lip of the cup expands permanently to a diameter larger than the smaller diameter section of the seal bore;

an unrestricted flow path configured to allow hydraulic fluid to pass through the seal bore as the piston moves through the seal bore towards the low pressure chamber to reset the tool; and a restricted flow path configured to restrict the flow of hydraulic fluid as the piston moves through the seal bore towards the high pressure chamber to fire the tool and create a jarring impact between the impact surfaces.

2. The hydraulic jarring tool of claim 1 wherein the larger diameter section of the seal bore comprises a tapered section, the larger diameter end of the tapered section being continuous with the high pressure chamber.

3. The hydraulic jarring tool of claim 2 wherein the smaller diameter section of the seal bore comprises a straight section extending between the smaller diameter end of the tapered section and the low pressure chamber.

4. The hydraulic jarring tool of claim 1 wherein the cup of the piston is formed of a metal.

5. The hydraulic jarring tool of claim 4 wherein the cup is formed of a copper alloy.

6. The hydraulic jarring tool of claim 5 wherein the seal bore is formed of alloy steel.

7. The hydraulic jarring tool of claim 1 wherein the piston comprises a piston base from which the cup extends, wherein the piston is part of a piston assembly that also includes a timing washer and a sleeve, wherein the sleeve has a cup end and a base end, wherein the sleeve is arranged coaxially inside the piston, wherein the timing washer has an annular piston face opposing the end of the piston base and the base end of the sleeve, wherein the piston is supported for slight axially movement relative to the piston face of the timing washer to create a space therebetween as the piston moves through the seal bore towards the low pressure chamber, and wherein the unrestricted flow path is formed in part by the space formed between the end of the piston base and the piston face of the timing washer, and wherein when the end of the piston base is urged against the piston face of the timing washer, the unrestricted flow path is closed and fluid is forced through the restricted flow path.

8. The hydraulic jarring tool of claim 7 wherein the base end of the piston sleeve and the piston face of the timing washer are configured to provide a flow channel therebetween, wherein the timing washer includes a restricted passageway continuous with the flow channel between the piston face of the timing washer and the base end of the piston sleeve, wherein the restricted passageway is configured to allow the hydraulic fluid therethrough when the end of the piston base is urged against the piston face of the timing washer as the piston moves through the seal bore towards the high pressure chamber, and wherein the restricted flow path is formed in part by the flow channel between the base end of the piston sleeve and the restricted passageway in the timing washer.

9. The hydraulic jarring tool of claim 8 wherein the restricted passageway in the timing washer is a spiral groove.

10. The hydraulic jarring tool of claim 1 wherein the seal bore comprises longitudinal grooves at the end of the seal bore that adjoins the low pressure chamber configured to prevent a fluid seal between the piston cup and the wall of the seal bore until a substantial portion of the piston cup is inside the seal bore.

11. A bottom hole assembly comprising the jarring tool of claim 1.

12. A tubing string comprising the bottom hole assembly of claim 11.

13. A coiled tubing system comprising the tubing string of claim 12.

14. A bidirectional hydraulic jarring tool for use with a well conduit in an oil or gas well, the tool comprising:

a housing;

a mandrel;

wherein one of the mandrel and the housing is attachable to the well conduit and the other of the mandrel and the housing is attachable to a fixed object in the well;

wherein the housing and the mandrel have telescopically engaged portions that are axially movable relative to each other to fire and reset the tool;

wherein the telescopically engaged portions of the housing and the mandrel are configured to form a sealed annular hydraulic chamber therebetween, the sealed annular hydraulic chamber including an upper chamber, a lower chamber, and a seal bore therebetween;

wherein the seal bore has an upper larger diameter section at the upper end, a lower larger diameter section at the lower end, and a smaller diameter section between the upper and lower larger diameter sections;

an impact surface formed on each of the housing and the mandrel;

a pair of piston assemblies supported in the sealed annular hydraulic chamber, the pair of piston assemblies comprising an upper piston assembly and a lower piston assembly;

wherein the upper piston assembly is supported in the sealed annular hydraulic chamber for relative movement between the upper and lower chambers through the seal bore, and wherein the upper piston assembly comprises a cup with an open end terminating in a lip, the open end of the cup facing the lower chamber, the cup being deformable in response fluid pressure, so that as the upper piston assembly moves through the lower larger diameter section of the seal bore towards the lower chamber, the lip of the cup expands permanently to a diameter larger than the smaller diameter section of the seal bore;

wherein the lower piston assembly is supported in the sealed annular hydraulic chamber for relative movement between the upper and lower chambers through the seal bore, and wherein the lower piston assembly comprises a cup with an open end terminating in a lip, the open end of the cup facing the upper chamber, the cup being deformable in response fluid pressure, so that as the lower piston assembly moves through the upper larger diameter section of the seal bore towards the upper chamber, the lip of the cup expands to a diameter larger than the smaller diameter section of the seal bore;

an unrestricted flow path in the upper piston assembly configured to allow hydraulic fluid to pass through the seal bore as the upper piston assembly moves through the seal bore towards the upper pressure chamber;

an unrestricted flow path in the lower piston assembly configured to allow hydraulic fluid to pass through the seal bore as the lower piston assembly moves through the seal bore towards the lower chamber;

a restricted flow path in the upper piston assembly to restrict the flow of hydraulic fluid as the upper piston assembly moves through the seal bore towards the lower chamber to fire the tool and create a upward impact between the impact surfaces;

a restricted flow path in the lower piston assembly to restrict the flow of hydraulic fluid as the lower piston assembly moves through the seal bore towards the upper chamber to fire the tool and create a downward impact between the impact surfaces.

15. The hydraulic jarring tool of claim 14 wherein the seal bore comprises a center straight section forming the smaller diameter section, wherein the upper larger diameter section is a tapered section with the large end continuous with the upper chamber, and wherein the lower larger diameter section is a tapered section with the large end continuous with the lower chamber.

16. The hydraulic jarring tool of claim 14 wherein the cup of each of the upper and lower piston assemblies is formed of a metal.

17. The hydraulic jarring tool of claim 16 wherein the cup of each of the upper and lower assemblies is formed of a copper alloy.

18. The hydraulic jarring tool of claim 17 wherein the seal bore is formed of alloy steel.

19. A bottom hole assembly comprising the jarring tool of claim 14.

20. A tubing string comprising the bottom hole assembly of claim 19.

21. A coiled tubing system comprising the tubing string of claim 20.

* * * * *